US007486303B2

(12) United States Patent
Akai et al.

(10) Patent No.: US 7,486,303 B2
(45) Date of Patent: Feb. 3, 2009

(54) CIRCUIT FOR ADJUSTING GRAY-SCALE VOLTAGES OF A SELF-EMITTING DISPLAY DEVICE

(75) Inventors: Akihito Akai, Yokohama (JP); Yasuyuki Kudo, Fujisawa (JP); Kazuo Okado, Kokubunji (JP)

(73) Assignee: Renesas Technology Corp., Tokyo (JP)

( * ) Notice: Subject to any disclaimer, the term of this patent is extended or adjusted under 35 U.S.C. 154(b) by 983 days.

(21) Appl. No.: 10/852,198

(22) Filed: May 25, 2004

(65) Prior Publication Data

US 2005/0007393 A1 Jan. 13, 2005

(30) Foreign Application Priority Data

May 28, 2003 (JP) ..... 2003-151223

(51) Int. Cl.
*G09G 5/10* (2006.01)

(52) U.S. Cl. ..... 345/690

(58) Field of Classification Search ..... 345/46, 345/76–84, 204, 87, 89, 95, 100
See application file for complete search history.

(56) References Cited

U.S. PATENT DOCUMENTS 6,593,934 B1 * 7/2003 Liaw et al. ..... 345/590
2002/0186230 A1 12/2002 Kudo et al. ..... 345/690
2003/0043132 A1 * 3/2003 Nakamura ..... 345/204

* cited by examiner

*Primary Examiner*—Sumati Lefkowitz
*Assistant Examiner*—Rodney Amadiz
(74) *Attorney, Agent, or Firm*—Antonelli, Terry, Stout & Kraus, LLP.

(57) ABSTRACT

An object of the present invention is to provide a signal line driving circuit capable of easily and optimally adjusting the gamma characteristics of R, G, and B self-emitting element groups (e.g., organic EL element groups) such that each gamma characteristic matches the characteristics of the self-emitting panel by accommodating variations among the characteristics of the R, G, and B self-emitting element groups, thereby providing enhanced image quality and versatility.

A self-emitting display driving circuit (a signal line driving circuit) 302 includes 3 gray-scale voltage generating circuits 311 and 3 control registers 308 for R, G, and B self-emitting element groups, respectively, and these gray-scale voltage generating circuits and control registers can be adjusted separately. This arrangement makes it possible to accommodate variations among the characteristics of the R, G, and B self-emitting element groups and thereby provide enhanced image quality on the self-emitting display.

4 Claims, 11 Drawing Sheets

801

| REGISTER VALUE | VALUES OF VARIABLE RESISTORS | | | | | |
|---|---|---|---|---|---|---|
| | 411 | 412 | 413 | 414 | 415 | 416 |
| 0000 | 24R | 24R | 27R | 27R | 27R | 24R |
| 0001 | 31R | 25R | 26R | 25R | 24R | 22R |
| 0010 | 38R | 25R | 24R | 23R | 22R | 19R |
| 0011 | 47R | 25R | 22R | 21R | 20R | 17R |
| 0100 | 56R | 25R | 20R | 19R | 17R | 14R |
| 0101 | 67R | 25R | 18R | 16R | 14R | 12R |
| 0110 | 77R | 24R | 16R | 14R | 12R | 10R |
| 0111 | 87R | 23R | 13R | 11R | 10R | 8R |
| 1000 | 97R | 22R | 11R | 9R | 8R | 6R |
| 1001 | 106R | 20R | 9R | 7R | 6R | 5R |
| 1010 | 113R | 18R | 7R | 6R | 5R | 3R |
| 1011 | 120R | 16R | 6R | 4R | 3R | 3R |

802

803

| REGISTER VALUE | VALUES OF VARIABLE RESISTORS | | | | | |
|---|---|---|---|---|---|---|
| | 411 | 412 | 413 | 414 | 415 | 416 |
| 0000 | 5R | 7R | 12R | 24R | 36R | 68R |
| 0001 | 7R | 10R | 14R | 25R | 35R | 62R |
| 0010 | 9R | 13R | 16R | 25R | 33R | 56R |
| 0011 | 12R | 16R | 18R | 25R | 30R | 50R |
| 0100 | 15R | 21R | 20R | 25R | 27R | 43R |
| 0101 | 19R | 26R | 22R | 25R | 24R | 36R |
| 0110 | 23R | 31R | 23R | 24R | 21R | 30R |
| 0111 | 27R | 36R | 24R | 23R | 17R | 24R |
| 1000 | 32R | 41R | 24R | 22R | 14R | 19R |
| 1001 | 36R | 46R | 24R | 20R | 12R | 15R |
| 1010 | 40R | 51R | 23R | 18R | 9R | 12R |
| 1011 | 44R | 55R | 22R | 16R | 7R | 9R |

| REGISTER VALUE | VALUES OF VARIABLE RESISTORS | | | | | |
|---|---|---|---|---|---|---|
| | UPPER SIDE | | | LOWER SIDE | | |
| | 411 | 412 | 413 | 414 | 415 | 416 |
| 000 | 14R | 21R | 28R | 23R | 29R | 36R |
| 001 | 17R | 22R | 25R | 27R | 32R | 31R |
| 010 | 19R | 23R | 22R | 32R | 31R | 25R |
| 011 | 22R | 23R | 19R | 37R | 31R | 21R |
| 100 | 24R | 23R | 16R | 41R | 31R | 17R |
| 101 | 26R | 23R | 14R | 46R | 30R | 13R |
| 110 | 29R | 23R | 12R | 50R | 28R | 10R |
| 111 | 33R | 22R | 9R | 54R | 27R | 8R |

CIRCUIT FOR ADJUSTING GRAY-SCALE VOLTAGES OF A SELF-EMITTING DISPLAY DEVICE

CLAIM OF PRIORITY

The present application claims priority from Japanese application JP 2003-151223, filed on May 28, 2003, the content of which is hereby incorporated by reference into this application.

BACKGROUND OF THE INVENTION

1. Field of the Invention

The present invention relates to a self-emitting display driving circuit for generating gray-scale voltages according to display data and outputting them to a self-emitting panel such as an organic EL panel, and more particularly to a self-emitting display driving circuit for organic EL displays, etc., capable of adjusting a gamma characteristic (a gray-scale number vs. brightness characteristic).

2. Description of the Related Art

To display a high-quality image on an organic EL panel based on display data, it is necessary to set a gamma characteristic which matches the characteristics of the panel.

In the case of liquid crystal displays, Japanese Laid-Open Patent Publication No. 2002-366112 (Patent Document 1) discloses a circuit capable of adjusting the gamma characteristic of a liquid crystal display.

According to Patent Document 1, a gray-scale voltage generating circuit comprises a gamma adjustment control register made up of an amplitude adjustment register, a gradient adjustment register, and a fine adjustment register. The gray-scale voltage generating circuit also comprises: a ladder resistor for generating each (reference) gray-scale voltage from an externally supplied reference voltage with respect to ground GND, the ladder resistor being made up of variable resisters; a voltage divider circuit for further dividing each voltage generated by the ladder resistor (variable resistors); selector circuits for, according to the value set in the fine adjustment register, selecting some of the voltages generated by the voltage divider circuit; amplifier circuits for buffering the output voltages of the selector circuits; and an output ladder resistor for dividing the output voltages of the amplifier circuits into a desired number of gray-scale voltages. The resistance values of the lower side variable resistor and the upper side variable resistor respectively connected to the lower terminal and the upper terminal of the ladder resistor can be set by setting the amplitude adjustment register. The voltages generated by these two variable resistors are set to be the gray-scale voltages for the maximum and minimum gray-scale numbers, respectively.

Further, the resistance values of the two variable resistors respectively inserted at an upper middle position and a lower middle position of the ladder resistor can be set by setting the gradient adjustment register. The voltages generated by these two variable resistors are set to be the gray-scale voltages for gray-scale numbers which determine the gradient characteristic of the middle portion of the gray-scale number vs. gray-scale voltage characteristic curve.

Further, the gray-scale voltages generated by the above variable resistors (whose resistance values are set using the amplitude adjustment register and the gradient adjustment register) are subdivided by the voltage divider circuit to produce gray-scale voltages for fine adjustment. Then, some of the gray-scale voltages for fine adjustment are selected by the selector circuits according to the value of the fine adjustment register.

As described above, according to Patent Document 1, a liquid crystal display includes a gray-scale voltage generating circuit which adjusts each gray-scale voltage according to a desired gamma characteristic matching the characteristics of each liquid crystal panel by use of the amplitude adjustment register, the gradient adjustment register, and the fine adjustment register.

The prior art technique described in Patent Document 1 can be used to adjust the gamma characteristic of each of the R (red), G (green), and B (blue) color components in a liquid crystal panel, separately. However, each liquid crystal element in a panel exhibits the same characteristics, and therefore the above technique is intended to accommodate variations among the light transmittances of the R, G, and B color filters. In the case of organic EL panels, however, there are variations among the characteristics of the R, G, and B organic EL light-emitting element groups even in the same panel.

First, a description will be given of variations among the characteristics of self-emitting elements such as organic EL light-emitting elements with reference to FIG. 1. FIG. 1A shows I-B characteristics of a self-emitting panel such as an organic EL panel. Specifically, this figure shows exemplary variations among the I-B characteristics of the R, G, and B element groups. As shown in the figure, the R, G, and B element groups each exhibit a different current value I at the same brightness. FIG. 1B shows V-I characteristics of the self-emitting panel. Specifically, this figure shows exemplary variations among the V-I characteristics of the R, G, and B element groups. As shown in the figure, the R, G, and B element groups each exhibit a different voltage level V at the same control current I.

In view of the above problem that there are variations among the characteristics (I-B characteristics and V-I characteristics) of the. R, G, and B self-emitting element groups, it is an object of the present invention to provide a self-emitting display driving circuit capable of adjusting the gamma characteristics of the R, G, and B element groups separately such that each group exhibits substantially the same brightness characteristic.

SUMMARY OF THE INVENTION

To accommodate variations among the characteristics of the R, G, and B self-emitting element groups (e.g., organic EL element groups), a self-emitting display driving circuit of the present invention is configured as follows. Two selector circuits are respectively provided on the reference voltage side and the ground GND side of a ladder resistor, and the selector circuits select the voltages for the maximum and minimum gray-scale numbers from the voltages generated by the ladder resistor. FIG. 2A is a diagram showing gray-scale number vs. gray-scale voltage characteristics obtained when the difference voltage (or the amplitude voltage) between the maximum and minimum gray-scale voltages is changed. It should be noted that the select signals for the above selector circuits can be set using a register (referred to as an amplitude adjustment register).

Further, to adjust the curve characteristic (the curve shape) of the intermediate portion of a gray-scale number vs. gray-scale voltage characteristic curve, a plurality of variable resistors are provided between the gray-scale voltages for the maximum and minimum gray-scale numbers, and the resistance values of the variable resistors are selected (from candidate resistance values). FIG. 2B is a diagram showing gray-scale number vs. gray-scale voltage characteristics obtained when the curve characteristic of the intermediate portion is changed (with the voltages for the maximum and minimum gray-scale numbers set to fixed values). It should be noted that the resistance values of the above variable resistors can be set using a register (referred to as a curve adjustment register).

It should be noted that the self-emitting display driving circuit includes 3 gray-scale voltage generating circuits for the R, G, and B self-emitting element groups (e.g., organic EL element groups), respectively, as shown in FIG. 3 in order to accommodate variations among the characteristics of these groups. The gray-scale voltage generating circuits for the R, G, and B element groups can separately adjust the gamma characteristics of these groups by adjusting the amplitude characteristic and the curve characteristic of each gray-scale number vs. gray-scale voltage characteristic curve.

Thus, the amplitude adjustment register and the curve adjustment register can be used to set gray-scale voltages matching characteristics of R, G, and B self-emitting elements (e.g., organic EL light-emitting elements) as shown in FIGS. 1A and 1B, making it possible to enhance the image quality as well as increasing the adjustment range and versatility.

BRIEF DESCRIPTION OF THE DRAWINGS

FIG. 1, which includes FIG. 1A shows variations among the I-B characteristics of the R, G, and B elements and FIG. 1B shows variations among the V-I characteristics of the R, G, and B elements.

FIG. 2, which includes FIGS; 2A and 2B, is a diagram illustrating how a gray-scale number vs. gray-scale voltage characteristic (corresponding to a gamma characteristic curve) is adjusted according to the present invention; specifically.

FIG. 8, which includes FIG. 8A is a diagram showing an exemplary relationship between the register value and the resistance values of the variable resistors, and FIG. 8B is a diagram showing how a gray-scale number vs. gray-scale voltage characteristic is adjusted by setting the curve adjustment register.

FIG. 9, which includes FIG. 9A is a diagram showing an exemplary relationship between the register value and the resistance values of the variable resistors, and FIG. 9B is a diagram showing how a gray-scale number vs. gray-scale voltage characteristic is adjusted by setting the curve adjustment register.

FIG. 11, which includes FIG. 11A is a diagram showing an exemplary relationship between the register value (of the curve adjustment register) and the resistance values of the variable resistors, and FIG. 11B is a diagram showing how a gray-scale number vs. gray-scale voltage characteristic is adjusted by setting the amplitude adjustment register and the curve adjustment register.

DESCRIPTION OF THE PREFERRED EMBODIMENTS

A description will be given of a self-emitting display and self-emitting display driving circuits capable of adjusting a gamma characteristic (gray-scale number vs. brightness characteristic) according to preferred embodiments of the present invention with reference to the accompanying drawings.

First, a description will be given of the configuration of a self-emitting display according to a first embodiment of the present invention with reference to FIGS. 3 to 9.

Figure 3:
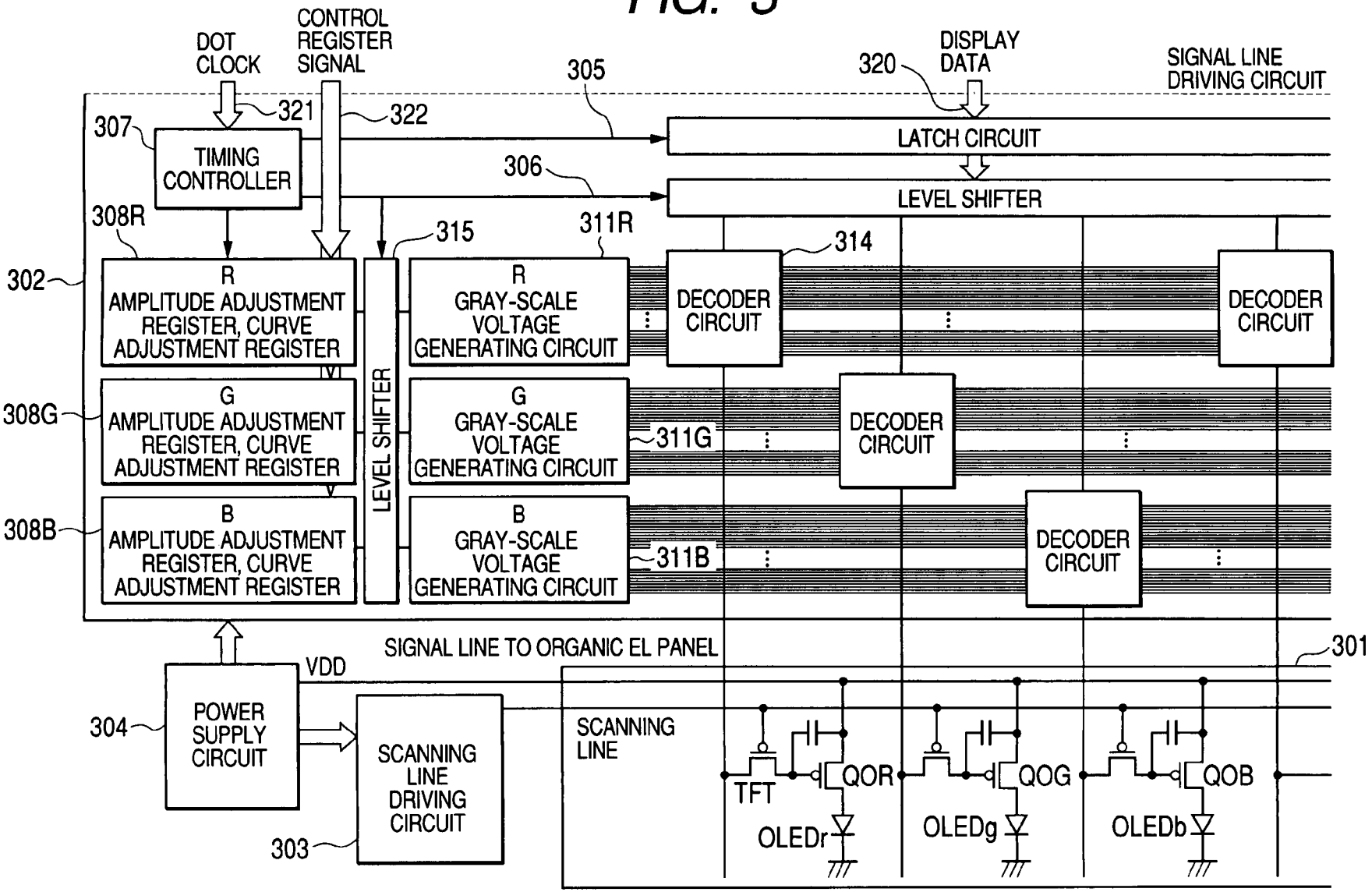
FIG. 3 is a diagram showing the configuration of an exemplary organic EL display according to the present invention.

FIG. 3 shows an organic EL display (a self-emitting display) which comprises: an organic EL panel 301 (a self-emitting panel); a signal line driving circuit 302 for driving the signal lines of the organic EL panel 301; a scanning line driving circuit 303 for driving the scanning lines of the organic EL panel 301; and a power supply circuit 304 for supplying power to each driving circuit and the organic EL panel. The organic EL panel 301 (a self-emitting panel) is of an active matrix type in which a TFT is provided for each pixel and the signal lines and the scanning lines are arranged in a matrix and connected to the pixels. The source terminals of the TFTs are respectively connected to the gate terminals of MOS transistors (Q0R, Q0G, Q0B) respectively connected in series to organic EL elements (OLEDr, OLEDg, OLEDb) provided between the supply voltage VDD and ground GND. The signal line driving circuit 302 supplies gray-scale voltages to the gate terminals of the MOS transistors (Q0R, Q0G, Q0B) through the signal lines. The amounts of current flowing through the organic EL elements (OLEDr, OLEDg, OLEDb) change according to the gray-scale voltages applied to the gate terminals of the MOS transistors, thereby controlling the display brightness. It should be noted that the organic EL display (a self-emitting display) controls the gray-scale voltages applied to the MOS transistors (Q0R, Q0G, Q0B) according to display data 320 transmitted from the CPU.

A description will be given below of each block constituting the signal line driving circuit 302. Reference numeral 305 denotes a latch circuit; 306 and 315, level shifters; 307, a timing controller; 308R, 308G, and 308B, control registers; 311R, 311G, 311B, gray-scale generating circuits; and 314, a decoder circuit. It should be noted that the control registers 308R, 308G, and 308B each include an amplitude adjustment register and a curve adjustment register.

Thus, in FIG. 3, the gray-scale generating circuits 311R, 311G, and 311B and the control registers 308R, 308G, and 308B are separately provided for the organic EL elements OLEDr, OLEDg, and OLEDb, respectively, since there may be variations among the characteristics of these organic EL elements, as described above. In view of the fact that there may be variations among the characteristics (I-B characteristics and V-I characteristics) of the R, G, and B self-emitting element groups (such as organic EL element groups), the present invention employs the gray-scale voltage generating circuits 311R, 311G, and 311B for the R, G, and B self-emitting element groups, respectively, for adjusting the gamma characteristics of these groups separately so that they have substantially the same brightness characteristic, and generating gray-scale voltages. The control registers are configured such that each register can set the (gray-scale voltage) amplitude and the curve (shape of the gamma characteristic) of a respective group (R, G, or B) separately.

The timing controller 307, which includes a dot counter, counts a dot clock 321 entered from an external device and generates a line clock.

The latch circuit 305 operates with the fall timing of the line clock and transfers a single line of display data to the level shifter 306.

The level shifter 306 converts the display data transferred from the latch circuit 305 from the Vcc-GND level to the VDD-VSS level. The Vcc-GND level is the supply voltage level for the logic circuits, while the VDD-VSS level is the operational voltage level of the gray-scale voltage generating circuits 311R, 311G, and 311B and the decoder circuits 314. It should be noted that this conversion is needed to control each block at an appropriate operational voltage level.

The control registers 308R, 308G, and 308B for R, G, and B element groups, respectively, each include a latch circuit and operate with the fall timing of the line clock from the timing controller 307 to transfer a control register signal 322 from the CPU to the level shifter 315.

The level shifter 315 converts the control register signals transferred from the control registers 308R, 308G, and 308B from the Vcc-GND level to the VDD-GND level and transfers them to the gray-scale voltage generating circuits 311R, 311G, and 311B, respectively.

The gay-scale voltage generating circuits 311R, 311G, and 311B for R, G, and B element groups, respectively, each have a circuit configuration as described later and generate a plurality of gray-scale voltages according to a respective control register signal input through the level shifter 315.

Each decoder circuit 314, which functions as a D/A converter, converts the digital display data from the level shifter 306 into an analog gray-scale signal based on the analog gray-scale voltages generated by a respective one of the gray-scale voltage generating circuits 311R, 311G, and 311B for the R, G, and B element groups.

A description will be given below of the gray-scale voltage generating circuits 311R, 311G, and 311B and the control registers 308R, 308G, and 308B for the R, G, and B element groups, respectively, according to the present invention with reference to FIG. 4.

Reference numeral 308 denotes a control register for holding setting values for adjusting a gamma characteristic; 311, a gray-scale voltage generating circuit; and 314, a decoder portion for decoding display data into gray-scale voltages (or producing gray-scale voltages based on display data). It should be noted that the control register 308 includes an amplitude adjustment register 404 and a curve adjustment register 405.

The gray-scale voltage generating circuit 311 (corresponding to the gray-scale voltage generating circuits 311R, 311G, and 311B for the R, G, and B element groups) comprises: a ladder resistor 406 provided between a reference voltage supplied from an external device and ground GND; selector circuits 407 and 408 for selecting (the maximum and minimum) gray-scale voltage levels from a plurality of voltage levels generated by voltage divider circuits 428 and 429; operational amplifier circuits 409 and 410 for buffering the output voltages 426 and 427 of the selector circuits 407 and 408; variable resistors 411 to 416 for dividing the output voltages of the operational amplifier circuits 409 and 410; operational amplifier circuits 417 to 421 for buffering the voltages generated by the variable resistors 411 to 416; and an output ladder resistor 422 for dividing the output voltages 430 to 434 of the operational amplifier circuits 417 to 421 into a desired number of gray-scale voltages (for example, 64 gray-scale voltages).

It should be noted that the voltage level of the selector circuit 407 provided for the upper portion of the ladder resistor 406 can be set by setting a maximum gray-scale voltage setting value 423 of the amplitude adjustment register 404, while the voltage level of the selector circuit 408 provided for the lower portion of the ladder resistor 406 can be set by setting a minimum gray-scale voltage setting value 424 of the amplitude adjustment register 404. Thus, the selector circuits 407 and 408 output the gray-scale voltages for the minimum and maximum gray-scale numbers (that is, the maximum and minimum gray-scale voltages), respectively. This means that the amplitude (or the difference between the maximum and minimum gray-scale voltages) can be set by use of the amplitude adjustment register 404.

Furthermore, the resistance values of the variable resistors 411 to 416 can be set by setting a variable resistor setting value 425 of the curve adjustment register 405.

In the above configuration, the variable resistors 411 to 416 generate reference gray-scale voltages used for providing a desired gray-scale number vs. gray-scale voltage characteristic.

The generated reference gray-scale voltages are buffered by the operational amplifier circuits 417 to 421 at the subsequent stage. The output ladder resistor 422 appropriately divides the output voltages (reference gray-scale voltages) 430 to 434 of the operational amplifier circuits 417 to 421 to produce, for example, 64 gray-scale voltages for 64 gray-scale numbers, respectively. Then, the decoder circuit 314 decodes (converts) the display data into gray-scale voltages based on the 64 gray-scale voltages generated by the gray-scale voltage generating circuit 311 (provided for each of the R, G, and B element groups). Each decoded gray-scale voltage (output voltage) is applied to a respective one of R, G, and B group signal lines in the organic EL panel 301.

In other words, the gray-scale voltage generating circuits 311R, 311G, and 311B for R, G, and B element groups, respectively, each comprise: an amplitude adjustment circuit for adjusting the gray-scale voltages for the maximum and minimum gray-scale numbers; a curve adjustment circuit for dividing the output voltage of the amplitude adjustment circuit into a plurality of voltages and adjusting them to produce a plurality of reference gray-scale voltages for intermediate gray-scale numbers; and an output circuit for further dividing the plurality of reference gray-scale voltages obtained from the curve adjustment circuit to produce a desired number of gray-scale voltages. The above amplitude adjustment circuit includes: the ladder resistor 406 for dividing the reference voltage; the selector circuits 407 and 408 for selecting the voltages for the maximum and minimum gray-scale numbers from the voltages produced by the ladder resistor 406; and the operational amplifiers 409 and 410. The above curve adjustment circuit, on the other hand, includes: the plurality of variable resistors 411 to 416 connected in series between the maximum and minimum gray-scale voltages; and the plurality of operational amplifiers 417 to 421. The above output circuit includes the output ladder resistor 422 for dividing the reference gray-scale voltages. The output ladder resistor 422 generates, for example, 64 gray-scale voltages for 64 gray-scale numbers, respectively.

The above circuit configuration allows adjustment of the amplitude voltage and intermediate gray-scale voltages by setting the amplitude adjustment register 404 and the curve adjustment register 405, making it possible to easily adjust the gamma characteristic. The gamma characteristic may be adjusted such that it matches the characteristics of the organic EL element group, realizing a gray-scale voltage generating circuit capable of providing increased image quality.

A description will be given below of the selector circuits 407 and 408 of the present embodiment and of the relationship between the value of the amplitude adjustment register 404 and the operation of each selector circuit with reference to FIG. 5. FIG. 5 shows the internal configuration of the selector circuit 407. Reference numeral 501 denotes a voltage divider circuit corresponding to the voltage divider circuit 428 within the ladder resistor 406 shown in FIG. 4. Here, the voltage divider circuit 501 uses 7 resistors each having a resistance value of 3R to generate 8 amplitude adjustment voltage levels A to H (for adjusting the maximum gray-scale voltage). The selector circuit selects one of the 8 amplitude adjustment voltage levels based on a value 502 of the amplitude adjustment register 404. It should be noted that the above unit resistance R is preferably a few tens of kilo-ohms.

The selector circuit 407 is made up of a plurality of 2-to-1 (two inputs/one output) selectors. The $0^{th}$ bit of the register value 502 is used to set the (four) outputs of the first stage selector group 503; the $1^{st}$ bit is used to set the (two) outputs of the second stage selector group 504; and the $2^{nd}$ bit is used to set the output of the third stage selector 505.

If the register value 502 is set to a binary number of 000, the selector circuit outputs the amplitude adjustment voltage A generated by the voltage divider circuit 501 (as the maximum gray-scale voltage). If the register value 502 is set to a binary number of 111, the selector circuit outputs the amplitude adjustment voltage H generated by the voltage divider circuit 501 (as the maximum gray-scale voltage). Thus, each time the register value 502 of the amplitude adjustment register 404 is incremented by one, the selector circuit selects the next amplitude adjustment voltage among the series of amplitude adjustment voltages A to H.

It should be noted that the above relationship between the register value 502 and the output voltage of the selector circuit is by way of example only. Each bit of the register value 502 may be inverted to provide the opposite relationship. That is, each time the register value 502 of the amplitude adjustment register 404 is incremented by one, the selector circuit selects the next amplitude adjustment voltage among the series of amplitude adjustment voltages H to A.

Further, in the above arrangement, the register value has 3 bits and the selector circuit 407 selects one of the 8 amplitude adjustment voltages (as the maximum gray-scale voltage). However, the register value may have more bits and the selector circuit 407 may select from a larger number of voltages. Further, the resistance value of each resistor within the voltage divider circuit 501 in the above arrangement is set to 3R. However, it may be set to other than 3R. Reducing the resistance value of each resistor within the voltage divider circuit 501 increases the adjustment accuracy even though the amplitude adjustment range (the maximum gray-scale voltage adjustment range) decreases. Increasing the resistance value of each resistor within the voltage divider circuit 501, on the other hand, increases the amplitude adjustment range (the maximum gray-scale voltage adjustment range) even though the adjustment accuracy decreases.

Figure 4:
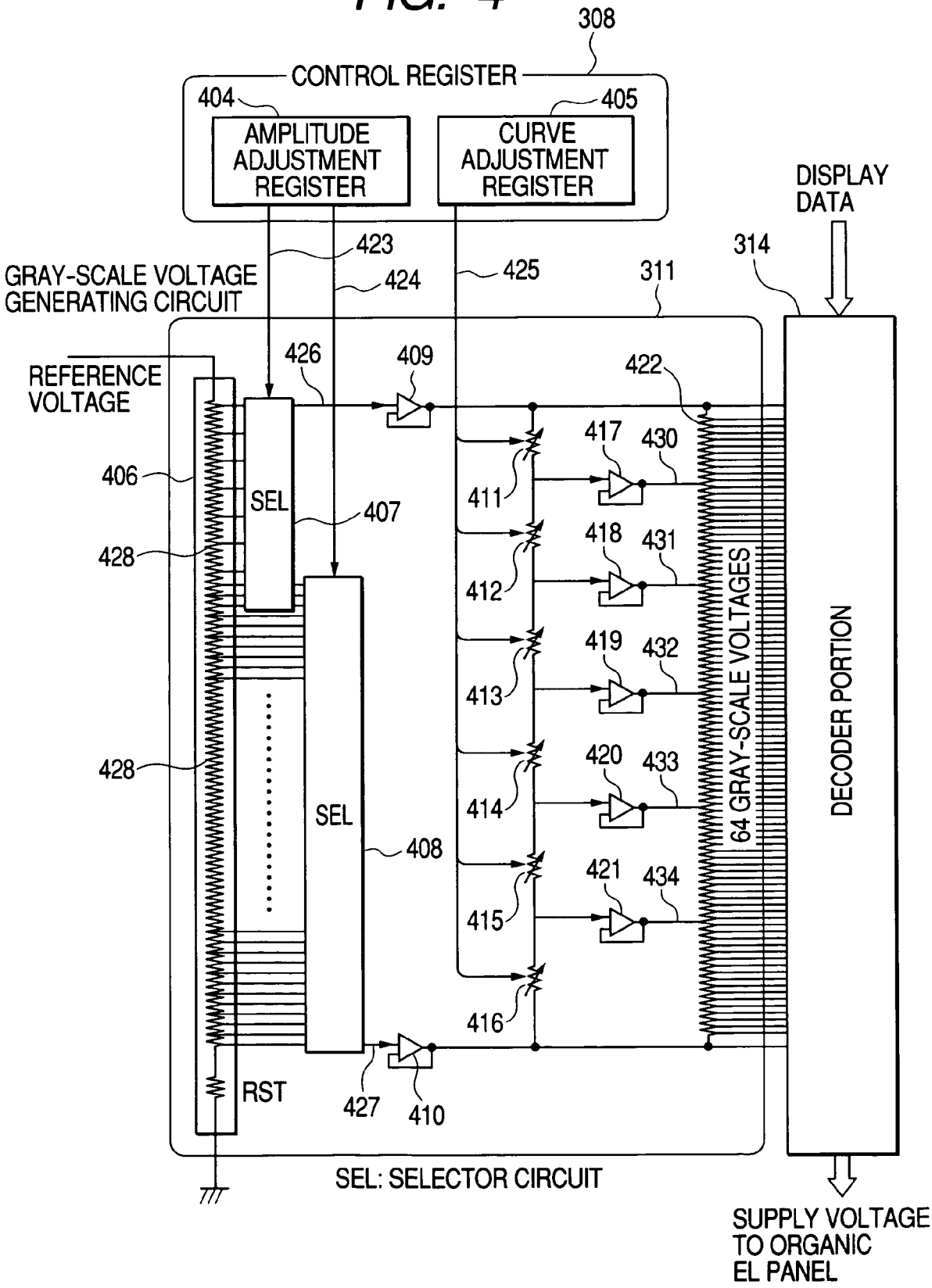
FIG. 4 is a diagram showing the configuration of a gray-scale voltage generating circuit within a signal line driving circuit (an organic EL driving circuit) according to a first embodiment of the present invention.
Figure 5:
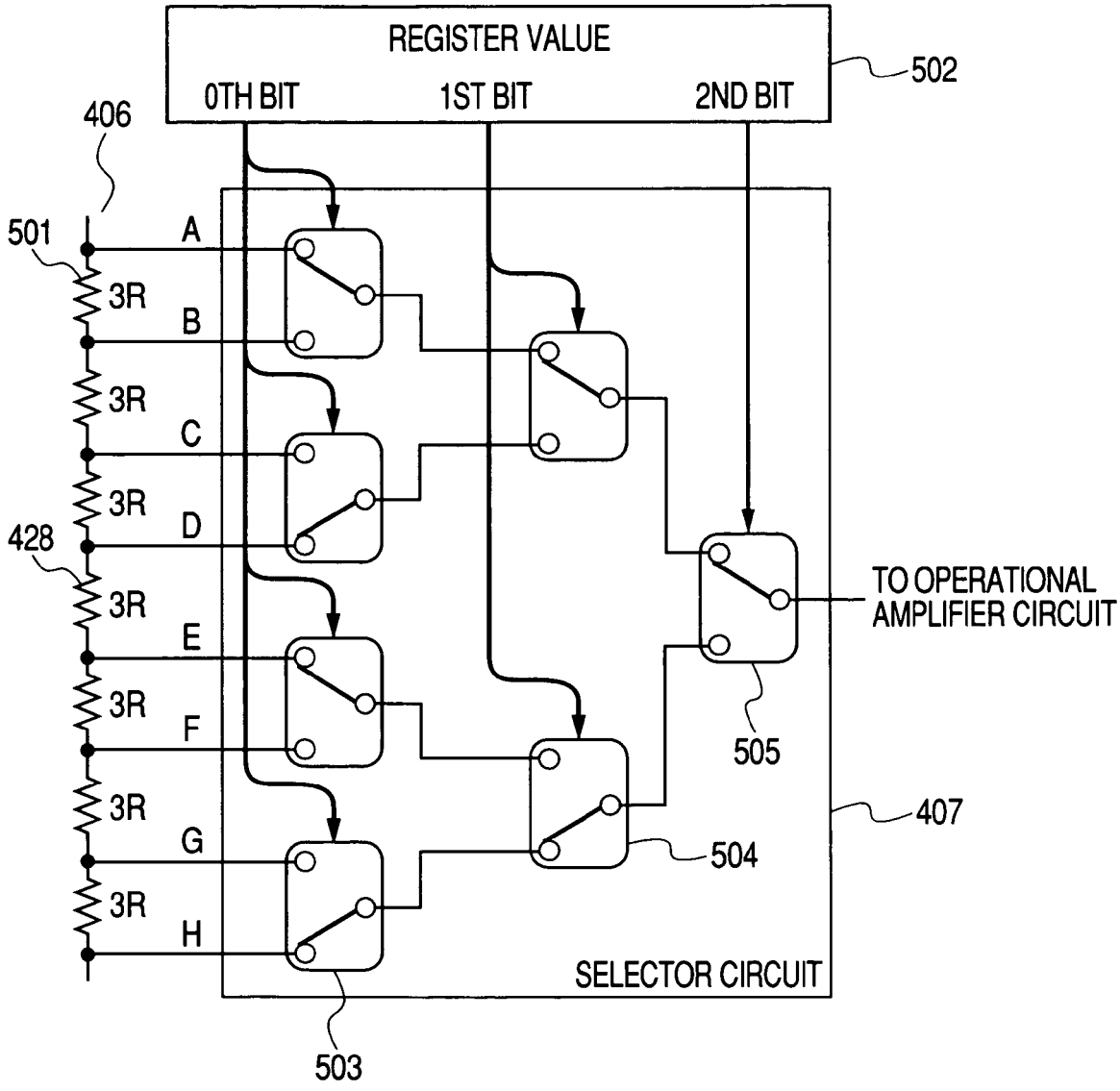
FIG. 5 is a diagram showing an exemplary selector circuit according to the present invention.

It should be noted that in the case of the lower side selector circuit 408 in FIG. 4, the resistance value of each resistor within the voltage divider circuit 429 is set to 1R and the resistor value has 7 bits, thereby increasing both the adjustment accuracy and the amplitude adjustment range (the minimum gray-scale voltage adjustment range).

Figure 6:
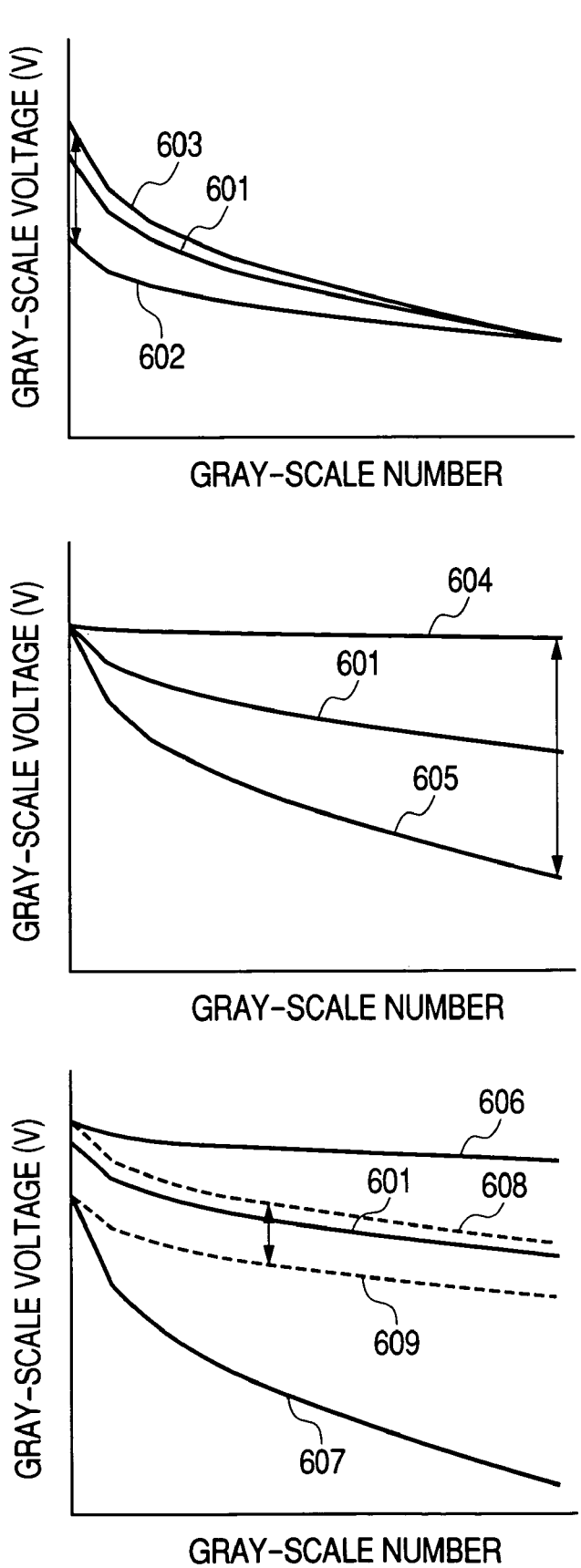
FIG. 6 is a diagram showing how a gray-scale number vs. gray-scale voltage characteristic (corresponding to a gamma characteristic) is adjusted by setting an amplitude adjustment register according to the present invention.

A description will be given below of how a gray-scale number vs. gray-scale voltage characteristic (corresponding to a gamma characteristic) is adjusted using the amplitude adjustment register 404 and the selector circuits 407 and 408 with reference to FIG. 6.

Reference numeral 601 denotes a gray-scale number vs. gray-scale voltage characteristic when the amplitude adjustment register 404 is set to a default value.

Reference numeral 602 denotes a gray-scale number vs. gray-scale voltage characteristic obtained when the amplitude voltage is reduced by changing (reducing) the maximum gray-scale voltage without changing the minimum gray-scale voltage. This is accomplished by setting the maximum gray-scale voltage setting value (register value) 423 of the amplitude adjustment register 404 such that the upper side selector circuit 407 selects the lowest voltage level. Reference numeral 603 denotes a gray-scale number vs. gray-scale voltage characteristic obtained when the amplitude voltage is increased by changing (increasing) the maximum gray-scale voltage without changing the minimum gray-scale voltage. This is accomplished by setting the maximum gray-scale voltage setting value 423 of the amplitude adjustment register 404 such that that the upper side selector circuit 407 selects the highest voltage level.

Thus, the voltage level selected by the upper side selector circuit 407 can be set by setting the maximum gray-scale voltage setting value 423 of the amplitude adjustment register 404, making it possible to adjust the amplitude voltage by changing the maximum gray-scale voltage without changing the minimum gray-scale voltage.

Reference numeral 604 denotes a gray-scale number vs. gray-scale voltage characteristic obtained when the amplitude voltage is reduced by changing (increasing) the minimum gray-scale voltage without changing the maximum gray-scale voltage. This is accomplished by setting the minimum gray-scale voltage setting value (register value) 424 of the amplitude adjustment register 404 such that the lower side selector circuit 408 selects the highest voltage level. Reference numeral 605 denotes a gray-scale number vs. gray-scale voltage characteristic obtained when the amplitude voltage is increased by changing (reducing) the minimum gray-scale voltage without changing the maximum gray-scale voltage. This is accomplished by setting the minimum gray-scale voltage setting value 424 of the amplitude adjustment register 404 such that the lower side selector circuit 408 selects the lowest voltage level.

Thus, the voltage level selected by the lower side selector circuit 408 can be set by setting the minimum gray-scale voltage setting value 424 of the amplitude adjustment register 404, making it possible to adjust the amplitude voltage by changing the minimum gray-scale voltage without changing the maximum gray-scale voltage.

Reference numerals 606 and 607 denote gray-scale number vs. gray-scale voltage characteristics obtained when the upper side selector circuit 407 and the lower side selector circuit 408 are set by use of the amplitude adjustment register 404 at the same time. Specifically, the gray-scale number vs. gray-scale voltage characteristic 606 is obtained when both the maximum and minimum gray-scale voltages are increased by setting the maximum and minimum gray-scale voltage setting values 423 and 424 of the amplitude adjustment register 404 such that the upper and lower side selector circuits 407 and 408 select their highest voltage levels. The gray-scale number vs. gray-scale voltage characteristic 607, on the other hand, is obtained when both the maximum and minimum gray-scale voltages are reduced by setting the maximum and minimum gray-scale voltage setting values 423 and 424 of the amplitude adjustment register 404 such that the upper and lower side selector circuits 407 and 408 select their lowest voltage levels. Reference numerals 608 and 609 denote gray-scale number vs. gray-scale voltage characteristics obtained when offset adjustments are made to the default gray-scale number vs. gray-scale voltage characteristic (601). The present embodiment is configured such that offset adjustment can be made by adjusting the voltage levels selected by the upper and lower selector circuits.

Figure 7:
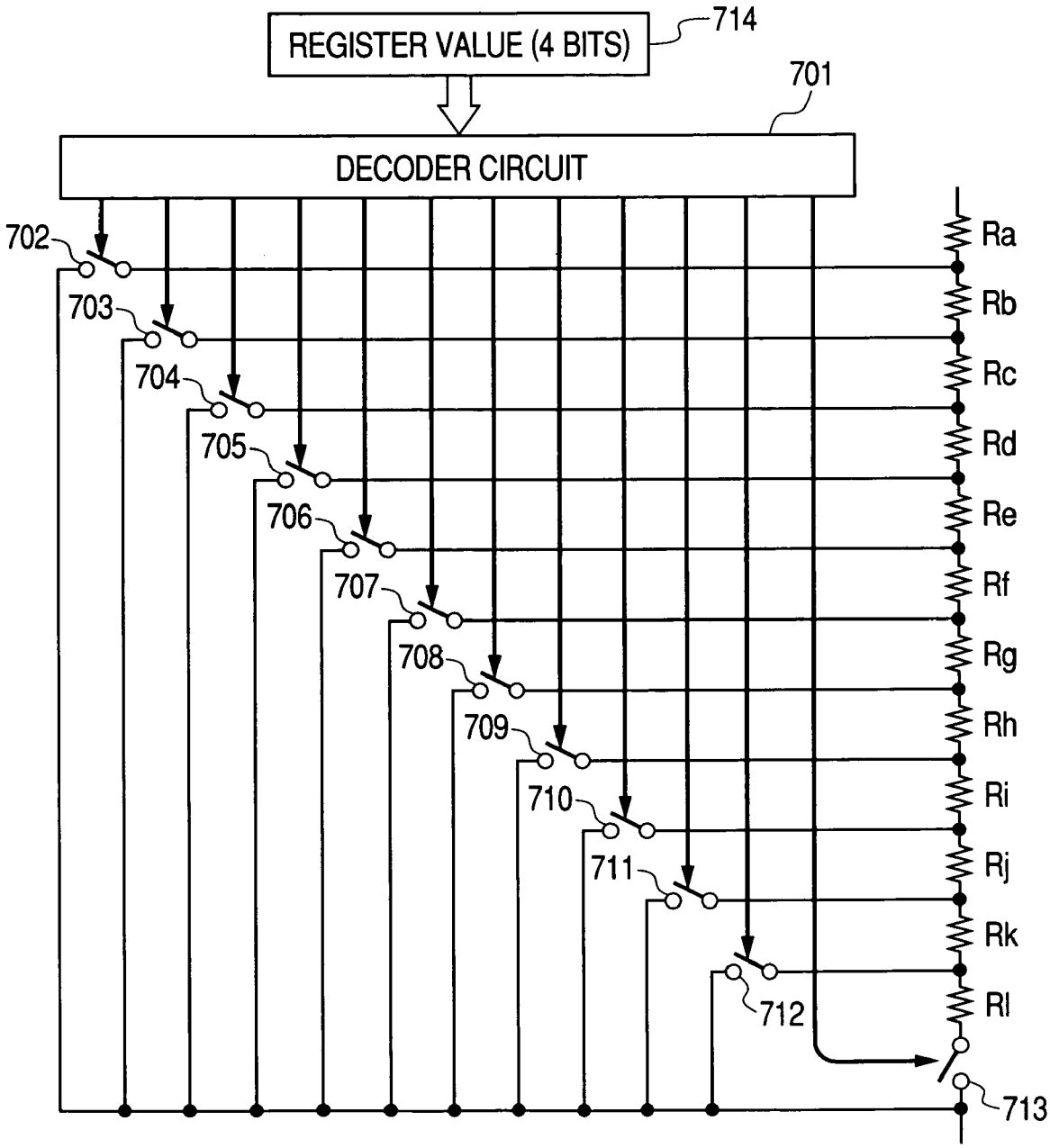
FIG. 7 is a diagram showing the configuration of an exemplary variable register according to the present invention.

A description will be given below of the variable resistors 411 to 416 of the present embodiment and of how they operate according to the value of the curve adjustment register 405 with reference to FIG. 7. FIG. 7 shows the internal configuration of an exemplary variable resistor corresponding to the variable resistors 411 to 416. Referring to the figure, the variable resistor employs 12 curve adjustment resistors Ra to Rl to provide 12 resistance values. The resistance value of the variable resistor depends on the number of curve adjustment resistors (among the curve adjustment resistors Ra to Rl) connected to the circuit, which is set by setting a variable resistor setting value (register value) 714 of the curve adjustment register 405.

Specifically, each variable resistor includes a decoder circuit 701, the 12 resistors Ra to R1, and 12 switches 702 to 713. The resistance value of the variable resistor is set by turning on one of the switches 702 to 713 through the decoder circuit 701 according to the variable resistor setting value 714.

If the variable resistor setting value 714 is set to a binary number of 0000, the decoder circuit 701 outputs a signal for turning on only the switch 702, and as a result, the total resistance value (the resistance value of the variable resistor) is set to Ra. If the variable resistor setting value 714 is set to a binary number of 1011, then the decoder circuit 701 outputs a signal for turning on only the switch 713, and as a result, the total resistance value (the resistance value of the variable resistor) is set to Ra+Rb+ . . . +R1. Thus, each time the variable resistor setting value 714 is incremented by one, the next curve adjustment resistor among the series of curve adjustment resistors Ra to Rl is additionally connected to the circuit and as a result, the total resistance value (the resistance value of the variable resistor) increases.

It should be noted that the above relationship between the variable resistor setting value and the resistance value of the variable resistor is by way of example only. The resistance value may decrease as the variable resistor setting value increases. Or the resistance value may be arbitrarily set for each variable resistor setting value separately. Further, in the above arrangement, the variable resistor setting value (the register value) has four bits and its maximum value is a binary number of 1100. However, the variable resistor setting value may have a different number of bits, other than 4, and the maximum variable resistor setting value may be changed. Increasing the number of bits of the variable resistor setting value or increasing the maximum variable resistor setting value increases the resistance value adjustment range of the variable resistors 411 to 416 even though the size of the circuit increases.

The above configuration allows the resistance values of the variable resistors 411 to 416 to be changed by setting the variable resistor setting value of the curve adjustment register 405.

With reference to FIG. 8, a description will be given below of how a gamma characteristic is adjusted by use of the curve adjustment register 405 and the variable resistors 411 to 416, wherein the output voltages (the reference gray-scale voltages) 430 to 434 of the operational amplifier circuits 417 to 421 are assigned to the gray-scale numbers 10, 20, 31, 42, and 53, respectively, that is, they are assigned to gray-scale numbers at almost equal intervals.

Figures 8A, 8B:
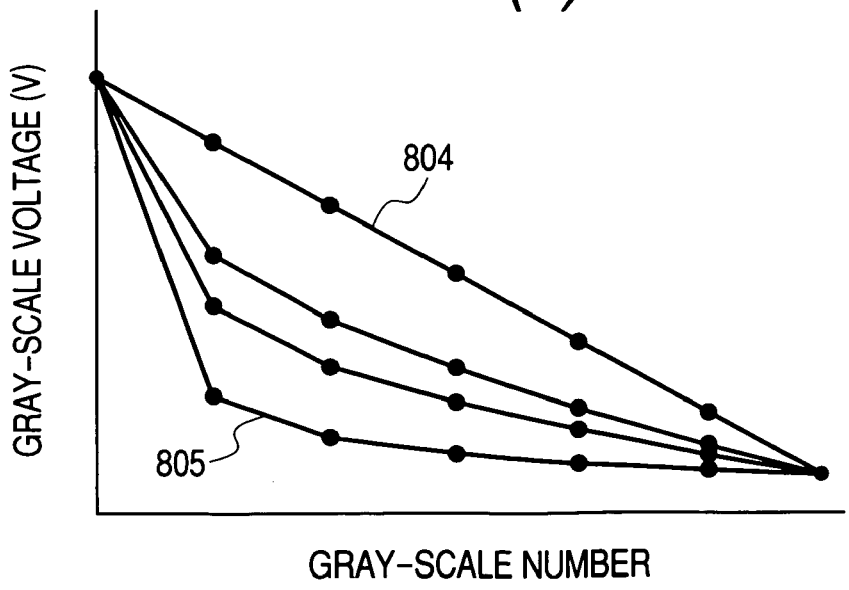
FIGS. 8A and 8B, is a diagram showing how a gray-scale number vs. gray-scale voltage characteristic (corresponding to a gamma characteristic) is adjusted by setting a curve adjustment register according to the present invention; specifically.

FIG. 8A is a diagram showing an exemplary relationship between the register value (the variable resistor setting value) 425 and the resistance values of the variable resistors 411 to 416, wherein reference numeral 801 indicates the set of resistance values which the variable resistor 411 can assume. It should be noted that as shown in FIG. 8A, the resistance values of the variable resistors 411 to 416 can be collectively set using the curve adjustment register 405. Reference numeral 802 indicates the resistance values of the variable resistors 411to 416 when the register value 425 of the curve adjustment register 405 is set to a binary number of 0000, while reference numeral 803 indicates the resistance values of the variable resistors 411 to 416 when the register value 425 is set to a binary number of 1011.

FIG. 8B shows how a gray-scale number vs. gray-scale voltage characteristic (corresponding to a gamma characteristic) is adjusted by setting the curve adjustment register 405. Reference numeral 804 denotes a gray-scale number vs. gray-scale voltage characteristic obtained when the curve adjustment register is set to a binary number of 0000, wherein the resistance values 802 of the variable resistors 411 to 416 are set such that the resultant gray-scale number vs. gray-scale voltage characteristic curve is linear (that is, the voltage difference between the gray-scale voltages for each two neighboring gray-scale numbers is equal). Reference numeral 805 denotes a gray-scale number vs. gray-scale voltage characteristic obtained when the curve adjustment register is set to a binary number of 1011, wherein the resistance values 803 of the variable resistors 411 to 416 are set such that the resultant gray-scale number vs. gray-scale voltage characteristic curve is downwardly convex (that is, the voltage difference between the gray-scale voltages for each two neighboring gray-scale numbers increases with decreasing gray-scale number. If it is intended to obtain an upwardly convex gray-scale number vs. gray-scale voltage characteristic curve, the resistance values of the variable resistors 411 to 416 may be set such that the voltage difference between the gray-scale voltages for each two neighboring gray-scale numbers decreases with decreasing gray-scale number. It should be noted that in FIG. 4, a total of 6 variable resistors (the variable resistors 411 to 416) are used. However, a different number of variable resistors may be employed.

Further, in the above arrangement, the variable resistor setting value (the register value) for the variable resistors has 4 bits and its maximum value is a binary number of 1011. However, the number of bits and the maximum value may be increased. Such an arrangement increases the number of resistance values which can be set for each variable resistor, as well as increasing the characteristic curve adjustment range and the adjustment accuracy even though the size of the circuit increases.

In the above arrangement shown in FIG. 4, a plurality of combinations of resistance values are predetermined (each value for one of the variable resistors as shown in FIG. 8) such that each combination provides a different gray-scale number vs. gray-scale voltage characteristic of an organic EL panel. With this, one of the combinations can be selected using the curve adjustment register. However, it may be arranged that the resistance value of each variable resistor can be set separately.

Thus, a gray-scale number vs. gray-scale voltage characteristic can be adjusted by changing the amplitude voltage and intermediate gray-scale voltages according to the register values of the amplitude adjustment register 404 and the curve adjustment register 405 of the control register 308. This facilitates adjustment of the gamma characteristic of organic EL light-emitting elements. A gray-scale voltage generating circuit may be provided for each of the R, G, and B element groups to adjust the gamma characteristic of each group separately. This arrangement makes it possible to set gray-scale voltages matching the characteristics of the R, G, and B organic EL light-emitting elements in the organic EL panel and thereby provide gray-scale voltage generating circuits capable of providing increased image quality, which is an object of the present invention.

Figure 1A:
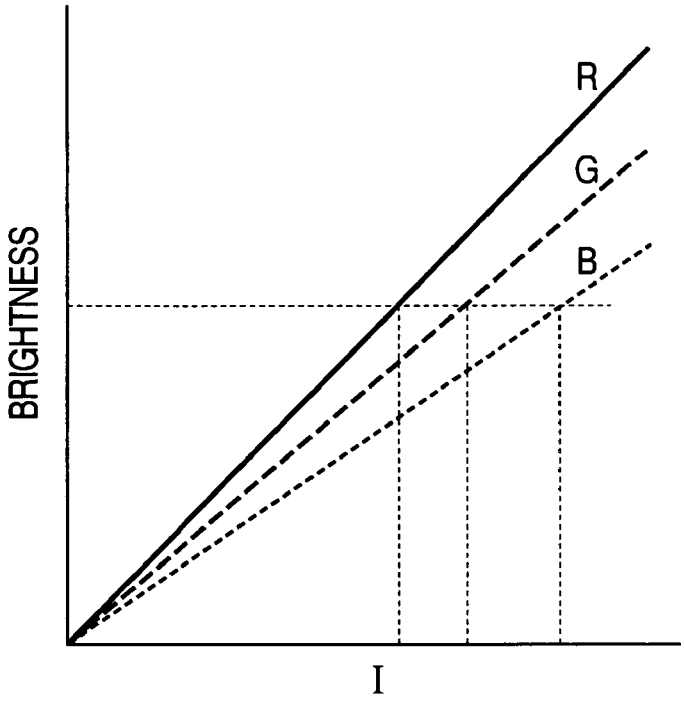
FIGS. 1A and 1B, is a diagram illustrating variations among the characteristics of R (red), G (green), and B (blue) organic EL light-emitting elements according to the present invention; specifically.
Figure 1B:
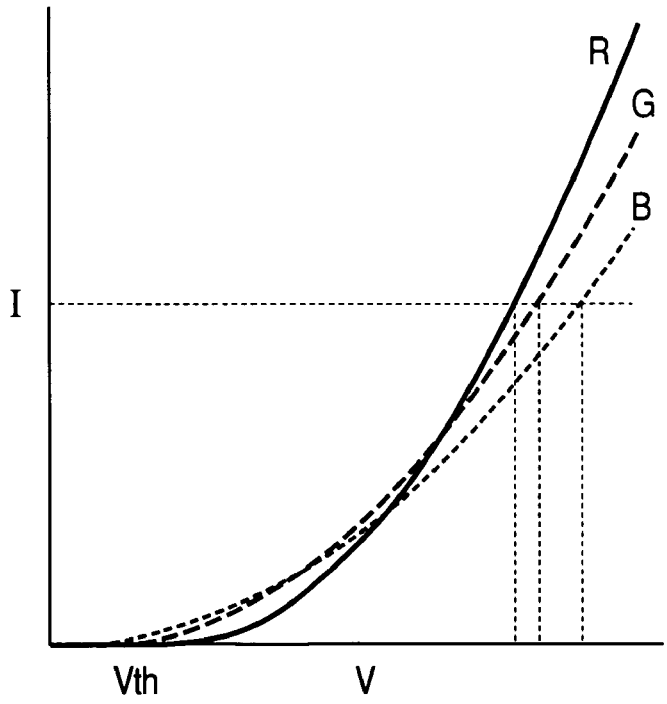
Figure 2A:
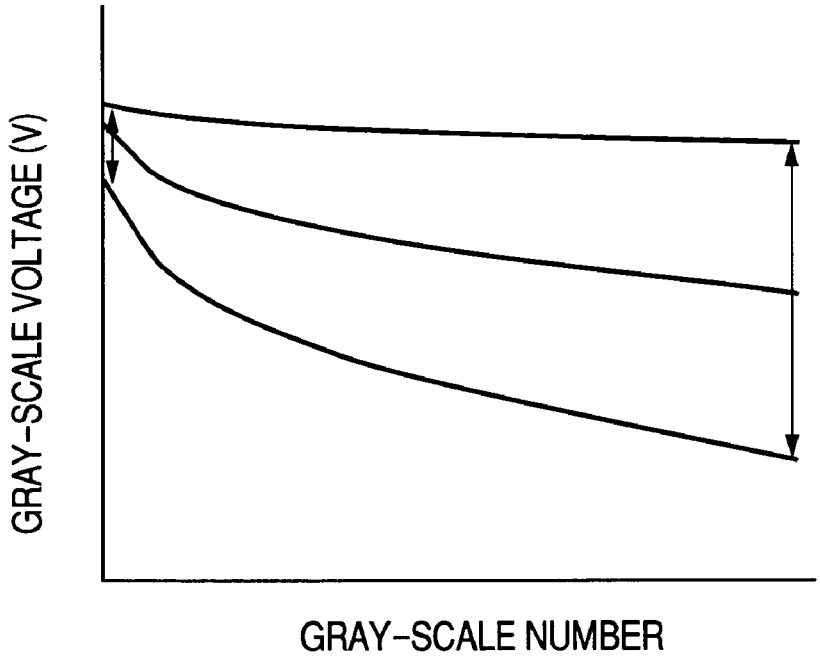
FIG. 2A shows gray-scale number vs. gray-scale voltage characteristic curves obtained when the maximum and minimum gray-scale voltages are changed (gray-scale voltage amplitude adjustment)
Figure 2B:
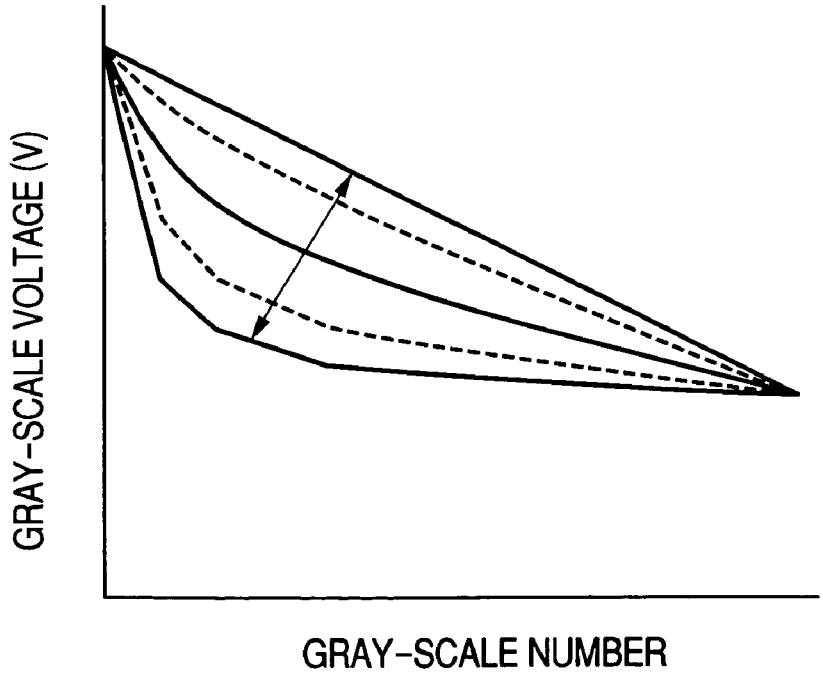
FIG. 2B shows gray-scale number vs. gray-scale voltage characteristic curves obtained when intermediate gray-scale voltages are changed with the maximum and minimum gray-scale voltages set to fixed values (gray-scale voltage curve adjustment).

A description will be given below of the configuration of an organic EL driving circuit (a self-emitting display driving circuit) according to a second embodiment of the present invention with reference to FIGS. 2, 8, and 9. It should be noted that the configuration of the second embodiment is the same as that of the first embodiment except for the organic EL driving circuit.

FIG. 8B shows exemplary gray-scale number vs. gray-scale voltage characteristic curves according to the first embodiment. These characteristic curves are not smoothly curved especially when the gray-scale number is small, as compared to the ideal gray-scale number vs. gray-scale voltage characteristic curves shown in FIG. 2. This means that a desired brightness characteristic might not be obtained depending on the display data. It should be noted that the reason why the above characteristic curves of the first embodiment are not smoothly curved is that the reference gray-scale voltages 430 to 434 buffered by the operational amplifier circuits 417 to 421 are assigned to the gray-scale numbers 10, 20, 31, 42, and 53 (gray-scale numbers at almost equal intervals), respectively, and then divided by the output ladder resistor 422 such that the resultant gray-scale number vs. gray-scale voltage characteristic curve is linear (that is, the voltage difference between the gray-scale voltages for each two neighboring gray-scale numbers is equal). The second embodiment is based on the fact that an ideal gray-scale number vs. gray-scale voltage characteristic curve of an organic EL element is such that the voltage difference between the gray-scale voltages for each two neighboring gray-scale numbers decreases with increasing gray-scale number. Specifically, according to the second embodiment, the difference between each two neighboring gray-scale numbers to which reference gray-scale voltages are assigned (from among the reference gray-scale voltages 430 to 434) decreases with decreasing gray-scale number. That is, according to the second embodiment, the reference gray-scale voltages 430 to 434 are divided by the output ladder resistor 422 such that: when the gray-scale number is small, the voltage difference between the gray-scale voltages for each two neighboring gray-scale numbers to which reference gray-scale voltages are assigned is smaller than in the first embodiment; and when the gray-scale number is large, the voltage difference between the gray-scale voltages for each two neighboring gray-scale numbers to which reference gray-scale voltages are assigned is larger than in the first embodiment.

Figures 9A, 9B:
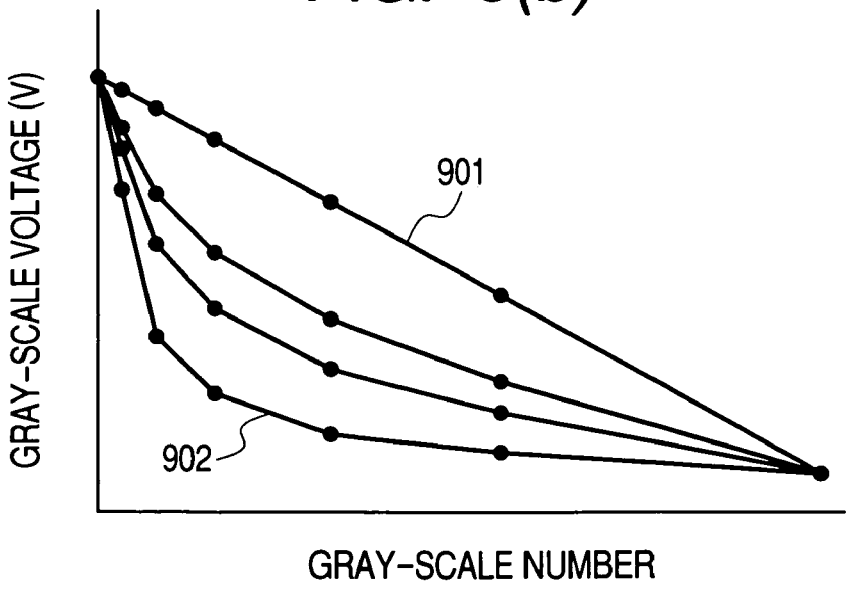
FIGS. 9A and 9B, is a diagram showing how a gray-scale number vs. gray-scale voltage characteristic (corresponding to a gamma characteristic) is adjusted by setting a curve adjustment register differently than in FIG. 8 according to the present invention; specifically.

FIG. 9A is a diagram showing an exemplary relationship between the register value (the variable resistor setting value) 425 and the resistance values of the variable resistors 411 to 416 when the reference gray-scale voltages 430 to 434 buffered by the operational amplifier circuits 417 to 421 are assigned to the gray-scale numbers 2, 5, 10, 20, 35, respectively. FIG. 9B shows how a gray-scale number vs. gray-scale voltage characteristic is adjusted by setting the curve adjustment register 405. Reference numeral 901 denotes a gray-scale number vs. gray-scale voltage characteristic curve obtained when the curve adjustment register is set to a binary number of 0000, while reference numeral 902 denotes a gray-scale number vs. gray-scale voltage characteristic curve obtained when the curve adjustment register is set to a binary number of 1011.

The gray-scale number vs. gray-scale voltage characteristic curve 901 is similar to the gray-scale number vs. gray-scale voltage characteristic curve 804 (both characteristic curves are obtained when the register value 425 of the curve adjustment register is set to a binary number of 0000). However, the gray-scale number vs. gray-scale voltage characteristic curve 902 differs from the gray-scale number vs. gray-scale voltage characteristic curve 805 especially at small gray-scale numbers even though both of them are obtained when the register value 425 of the curve adjustment register is set to a binary number of 1011. The reference gray-scale voltages 430 to 434 obtained through the variable resistors 411 to 416 are divided by the output ladder resistor 422 such that the difference between each two neighboring gray-scale numbers to which reference gray-scale voltages are assigned decreases with decreasing gray-scale number (for example, the reference gray-scale voltages 430 to 434 are assigned to the gray-scale numbers 2, 5, 10, 20, and 35, respectively). Therefore, at small gray-scale numbers, the voltage difference between the gray-scale voltages for each two neighboring gray-scale numbers to which reference gray-scale voltages are assigned is smaller than in the first embodiment. At large gray-scale numbers, on the other hand, the voltage difference between the gray-scale voltages for each two neighboring gray-scale numbers to which reference gray-scale voltages are assigned is larger than in the first embodiment. As a result, gray-scale number vs. gray-scale voltage characteristic curves as shown in FIG. 9B are obtained which are more similar to the ideal gray-scale number vs. gray-scale voltage characteristic curves shown in FIG. 2.

It should be noted that the above gray-scale numbers to which the reference gray-scale voltages 430 to 434 are assigned are by way of example only. They may be determined depending on the characteristics of the organic EL elements.

The second embodiment is different from the first embodiment only in the internal configuration of the gray-scale voltage generating circuit 311 shown in FIG. 4. The configurations and operations of the control register 308 and the decoder portion 314 are the same as those of the first embodiment.

Thus, the reference gray-scale voltages 430 to 434 which can be set by use of the curve adjustment register 405 within the control register 308 are assigned to gray-scale numbers such that the difference between each two neighboring gray-scale numbers to which reference gray-scale voltages are assigned decreases with decreasing gray-scale number. This arrangement makes it possible to set gray-scale voltages matching the characteristics of the organic EL elements and thereby provide a gray-scale voltage generating circuit capable of providing increased image quality, which is an object of the present invention.

A description will be given below of the configuration of an organic EL driving circuit (a self-emitting display driving circuit) according to a third embodiment of the present invention with reference to FIGS. 10 and 11. It should be noted that the configuration of the third embodiment is the same as that of the first embodiment except for the organic EL driving circuit.

As described above, R, G, and B organic EL light emitting elements each exhibit a different gray-scale number vs. gray-scale voltage characteristic. Furthermore, each organic EL panel also has a different gray-scale number vs. gray-scale voltage characteristic. In view of this, it may be arranged that an appropriate curve can be selected from a plurality of gray-scale number vs. gray-scale voltage characteristic curves, as in the first and second embodiments. To do this, it is necessary to configure the above variable resistors 411 to 416 such that they can assume a plurality of resistance values or that the resistance value of each variable resistor can be adjusted separately. However, increasing the adjustment range or the adjustment accuracy of the characteristic curve through the former arrangement might lead to an increase in the size of the circuit. Doing so through the latter arrangement might lead to difficulty in adjusting the gamma characteristic in addition to an increase in the size of the circuit. To address this problem, the third embodiment is configured such that an intermediate gray-scale voltage (the gray-scale voltage for an intermediate gray-scale number) can be set by the amplitude adjustment register, in addition to the maximum gray-scale voltage (the gray-scale voltage for the minimum gray-scale number) and the minimum gray-scale voltage (the gray-scale voltage for the maximum gray-scale number) Specifically, the difference between the maximum gray-scale voltage and the intermediate gray-scale voltage (referred to as the first amplitude) and the difference between the intermediate gray-scale voltage and the minimum gray-scale voltage (referred to as the second amplitude) can be set (separately). Furthermore, the curve shape of the portion of the curve corresponding to the first amplitude and that corresponding to the second amplitude can be adjusted separately. This arrangement can increase versatility while preventing an increase in the size of the circuit.

A description will be given below of a gray-scale voltage generating circuit according to the third embodiment with reference to FIG. 10. Reference numeral 308 denotes a control register for holding setting values for adjusting a gamma characteristic; 311', a gray-scale voltage generating circuit; and 314, a decoder circuit for decoding display data into gray-scale voltages (or producing gray-scale voltages based on display data). It should be noted that the control register 308 includes an amplitude adjustment register 1003 and a curve adjustment register 1004.

The gray-scale voltage generating circuit 311' comprises: a ladder resistor 406 provided between a reference voltage supplied from an external device and ground GND; selector circuits 407, 1005, and 408 for selecting (the maximum, intermediate, and minimum) gray-scale voltage levels from a plurality of voltage levels generated by the ladder resistor 406; operational amplifier circuits 409, 410, and 1007 for buffering the output voltages 426, 427, and 1006 of the selector circuits 407, 408, and 1005; variable resistors 411 to 416 for dividing the output voltages of the operational amplifier circuits 409, 410, and 1007; operational amplifier circuits 417, 418, 420, and 421 for buffering the voltages generated by the variable resistors 411 to 416; and an output ladder resistor 422 for dividing the output voltages 430, 431, 1011, 433, and 434 of the operational amplifier circuits 417, 418, 1007, 420, and 421 into a desired number of gray-scale voltages (for example, 64 gray-scale voltages). That is, the gray-scale voltage generating circuit 311' differs from the gray-scale voltage generating circuit 311 shown in FIG. 4 in that: it has the selector circuit 1005 for selecting the intermediate gray-scale voltage (for the intermediate gray-scale number) and the operational amplifier circuit 1007 for buffering the output voltage 1006 of the selector circuit 1005; and the output voltage 1011 of the operational amplifier circuit 1007 is applied to the connection point between the variable resistors 413 and 414 and further applied to the output ladder resistor 422.

It should be noted that the voltage level of the selector circuit 407 provided for the upper portion of the ladder resistor 406 can be set by setting a maximum gray-scale voltage setting value 423 of the amplitude adjustment register 1003, while the voltage level of the selector circuit 408 provided for the lower portion of the ladder resistor 406 can be set by setting a minimum gray-scale voltage setting value 424 of the amplitude adjustment register 1003. Furthermore, the voltage level of the selector circuit 1005 provided for the intermediate portion of the ladder register 406 can be set by setting an intermediate gray-scale voltage setting voltage 1008 of the amplitude adjustment register 1003. A gray-scale voltage 426 and a gray-scale voltage 1006 selected by the selector circuits 407 and 1005, respectively, determine the first amplitude (the difference between the maximum and intermediate gray-scale voltages), while the gray-scale voltage 1006 and a gray-scale voltage 427 selected by the selector circuits 1005 and 408 determine the second amplitude (the difference between the intermediate and minimum gray-scale voltages). This means that the first and second amplitudes can be set by use of the amplitude adjustment register 1003.

Furthermore, the resistance values of the variable resistors 411 to 413 can be set by setting an upper side variable resistor setting value 1009 of the curve adjustment register 1004, while the resistance values of the variable resistors 414 to 416 can be set by setting a lower side variable resistor setting value 1010 of the curve adjustment register 1004.

In the above configuration, the variable resistors 411 to 416 divide the output voltages 426, 1011, and 427 of the selector circuits 407, 1005, and 408 to generate reference gray-scale voltages for producing a desired gray-scale number vs. gray-scale voltage characteristic.

The generated reference gray-scale voltages are buffered by the operational amplifier circuits 417, 418, 420, and 421 at the subsequent stage. The output ladder resistor 422 appropriately divides the output voltages (the reference gray-scale voltages) 430, 431, 1011, 433, and 434 of the operational amplifier circuits 417, 418, 1007, 420, and 421 to produce 64 gray-scale voltages for 64 gray-scale numbers, respectively. Then, the decoder portion (the decoder circuit portion) 314 decodes (converts) the display data into gray-scale voltages based on the 64 gray-scale voltages generated by the gray-scale voltage generating circuit 311'. Each decoded gray-scale voltage (output voltage) is applied to a respective one of the R, G, or B group signal lines in the organic EL panel.

Figure 10:
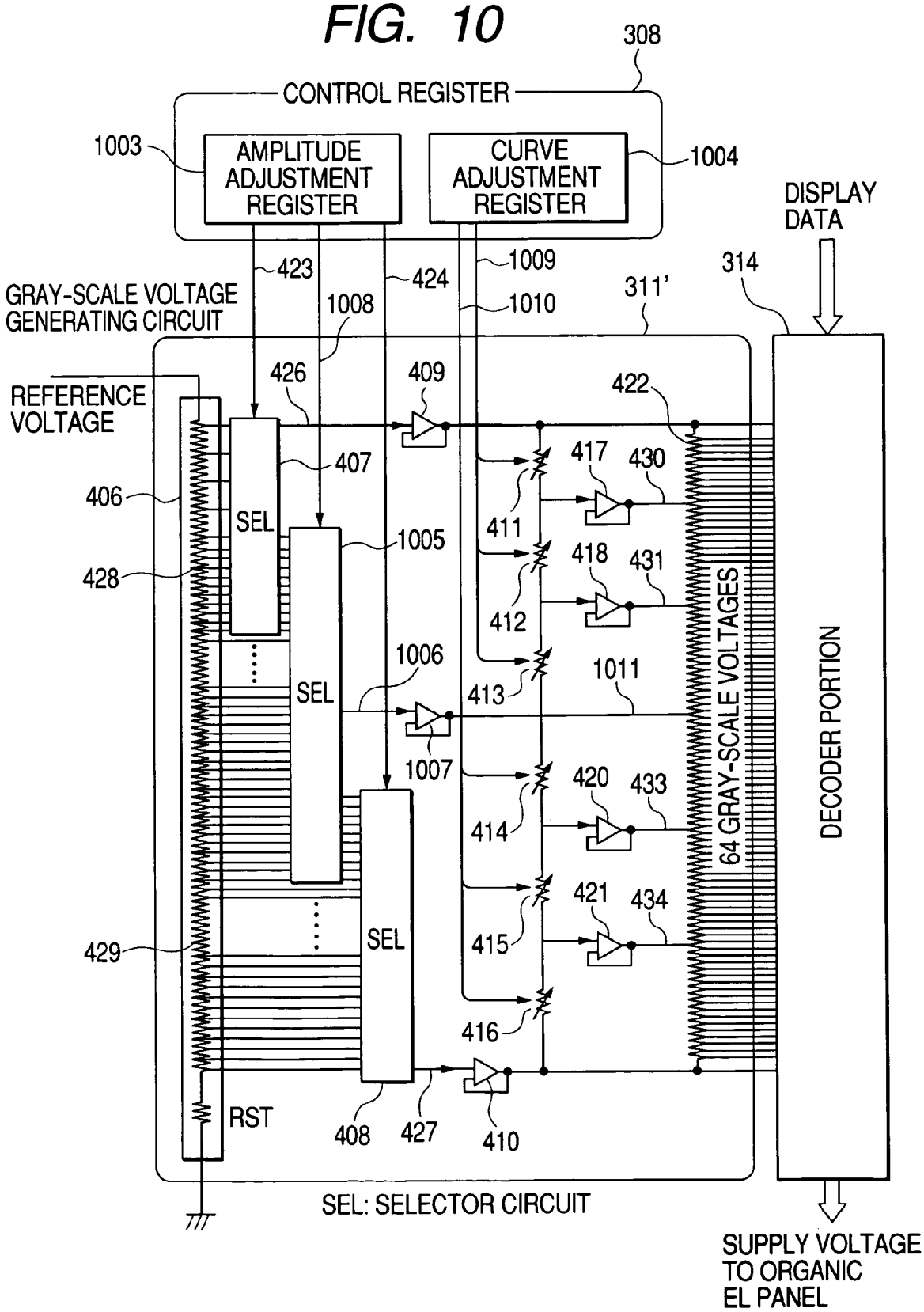
FIG. 10 is a diagram showing the configuration of a gray-scale voltage generating circuit within a signal line driving circuit (an organic EL driving circuit) according to a third embodiment of the present invention.
Figures 11A, 11B:
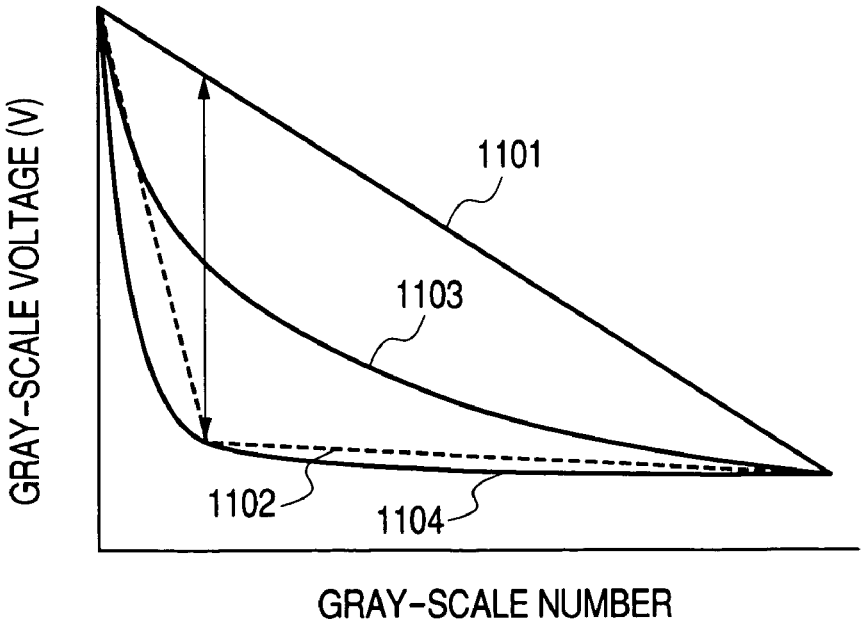
FIGS. 11A and 11B, is a diagram showing how a gray-scale number vs. gray-scale voltage characteristic (corresponding to a gamma characteristic) is adjusted by setting an amplitude adjustment register and a curve adjustment register in the gray-scale voltage generating circuit shown in FIG. 10 according to the present invention; specifically.

It should be noted that the circuit configuration shown in FIG. 10 is by way of example only. The selector circuits may select more than 3 gray-scale levels. Further, the gray-scale voltage level selected by the selector circuit 1005 may be buffered by the operational amplifier circuit 420. In such a case, the variable resistors set by setting the upper side variable resistor setting value 109 are the variable resistors 411 to 414, while the variable resistors set by setting the lower side variable resistor setting value 1010 are the variable resistors 415 and 416. The gray-scale voltages 430, 431, 1011, 433, and 434 are assigned to appropriate gray-scale numbers according to the characteristics of the organic EL elements, as in the second embodiment.

A description will be given below of how a gray-scale number vs. gray-scale voltage characteristic (corresponding to a gamma characteristic) is adjusted by use of the amplitude adjustment register 1003 and the middle selector circuit 1005 with reference to FIG. 11. Referring to FIG. 11, the gray-scale voltages 430, 431, 1011, 433, and 434 are assigned to the gray-scale numbers 2, 5, 9, 23, and 41, respectively. Furthermore, the upper side gray-scale voltage setting value (the maximum gay-scale voltage setting value) 423 for the upper side selector circuit 407 and the lower side gray-scale voltage setting value (the minimum gray-scale voltage setting value) 424 for the lower side selector circuit 408 are set to fixed values.

Reference numeral 1101 denotes a gray-scale number vs. gray-scale voltage characteristic obtained when the intermediate gray-scale voltage setting value 1008 and the upper and the lower side variable resistor setting values 1009 and 1010 are all set to a binary number of 000; reference numeral 1102 denotes a gray-scale number vs. gray-scale voltage characteristic obtained when the intermediate gray-scale voltage setting value 1008 is set to a binary number of 111 and the upper and the lower side variable resistor setting values 1009 and 1010 are both set to a binary number of 000; reference numeral 1103 denotes a gray-scale number vs. gray-scale voltage characteristic obtained when the intermediate gray-scale voltage setting value 1008 and the upper and the lower side variable resistor setting values 1009 and 1010 are all set to a binary number of 100; and reference number 1104 denotes a gray-scale number vs. gray-scale voltage characteristic obtained when the intermediate gray-scale voltage setting value 1008 and the upper and the lower side variable resistor setting values 1009 and 1010 are all set to a binary number of 111. It should be noted that even though the intermediate gray-scale voltage setting value 1008 in the above arrangement has 3 bits, it may have more bits in other arrangements.

It is possible to separately set the first amplitude characteristic curve (the portion of a gray-scale number vs. gray-scale voltage characteristic curve between the minimum gray-scale number and the intermediate gray-scale number) and the second amplitude characteristic curve (the portion of the gray-scale number vs. gray-scale voltage characteristic curve between the intermediate gray-scale number and the maximum gray-scale number) by use of the upper and the lower side variable resistor setting values 1009 and 1010, respectively. Therefore, a gray-scale number vs. gray-scale voltage characteristic can be arbitrarily adjusted by setting the setting values 1009 and 1010 in combination. Further, the gray-scale number which separates between the first amplitude characteristic curve and the second amplitude characteristic curve is the one to which the gray-scale voltage 1006 (which is selected using the intermediate gray-scale voltage setting value 108) is assigned. This gray-scale number can also be adjusted.

Thus, according to the third embodiment, when a gamma characteristic (or a gray-scale number vs. gray-scale voltage characteristic) is adjusted, the first and the second gray-scale voltage amplitudes and the first and the second amplitude characteristic curves can be adjusted separately by setting the amplitude adjustment register 1003 and the curve adjustment register 1004, making it possible to provide a gray-scale voltage generating circuit for a self-emitting display capable of providing increased image quality and versatility, which is an object of the present invention.

According to the present invention, a self-emitting display driving circuit has a gray-scale voltage generating circuit and a control register for each of the Rr, G, and B element groups, and these gray-scale voltage generating circuits and control registers can be adjusted separately, making it possible to accommodate variations among the characteristics of the R, G, and B self-emitting elements and thereby realize a self-emitting display capable of providing increased image quality.

Further according to the present invention, a gamma characteristic can be easily and optimally adjusted through two types of adjustment, such as amplitude adjustment and curve adjustment, according to the characteristics of the self-emitting elements, making it possible to increase the image quality and versatility.

Description of Reference Numerals

Reference numerals used in the accompanying drawings will be described below.

301 . . . organic EL panel (self-emitting panel)

302 . . . signal line driving circuit (self-emitting display driving circuit)

303 . . . scanning line driving circuit

304 . . . power supply circuit

305 . . . latch circuit

306 . . . level shifter

307 . . . timing controller

308, 308R, 308G, 308B . . . control register

311, 311', 311R, 311G, 311B . . . gray-scale voltage generating circuit

314 . . . decoder portion (decoder circuit portion)

315 . . . level shifter

320 . . . display data

321 . . . dot clock

322 . . . control register signal

404 . . . amplitude adjustment register

405 . . . curve adjustment register

406 . . . ladder register

407 . . . upper side selector circuit

408 . . . lower side selector circuit

409-410, 417-421 . . . operational amplifier circuit

411-416 . . . variable resistor

422 . . . output ladder register

423 . . . maximum gray-scale voltage setting value or upper side selector circuit setting value (amplitude adjustment value)

424 . . . minimum gray-scale voltage setting value or lower side selector circuit setting value (amplitude adjustment value)

425 . . . variable resistor setting value (curve adjustment value)

426 . . . gray-scale voltage for minimum gray-scale number

427 . . . gray-scale voltage for maximum gray-scale number

428-429 . . . voltage divider circuit

430-434 . . . operational amplifier output voltage (reference gray-scale voltage)

501 . . . voltage divider circuit

502 . . . register value

503-505 . . . switch

601-609 . . . gray-scale number vs. gray-scale voltage characteristic

701 . . . decoder circuit

702-713 . . . switch

714 . . . register value

801 . . . resistance values for resistor

802-803 . . . register value and resistance value group

804-805 . . . gray-scale number vs. gray-scale voltage characteristic

901-902 . . . gray-scale number vs. gray-scale voltage characteristic

1003 . . . amplitude adjustment register

1004 . . . curve adjustment register

1005 . . . selector circuit

1006 . . . middle selector circuit output voltage

1007 . . . operational amplifier circuit

1008 . . . intermediate gray-scale voltage setting value or middle selector circuit setting value

1009 . . . upper side variable resistor setting value

1010 . . . lower side variable resistor setting value

1011 . . . gray-scale voltage

1101-1104 . . . gray-scale number vs. gray-scale voltage characteristic

What is claimed is:

1. A self-emitting display driving circuit for driving signal lines for an R self-emitting element group, a G self-emitting element group, and a B self-emitting element group, respectively, in an active matrix type self-emitting panel, said self-emitting display driving circuit comprising:

a control register for setting an amplitude adjustment value and a curve adjustment value for each of said R, G, and B self-emitting element groups, separately;

gray-scale voltage generating circuits each for adjusting an amplitude characteristic and a curve characteristic of a gray-scale number vs. gray-scale voltage characteristic curve of a respective one of said R, G, and B self-emitting element groups, separately, based on said amplitude adjustment value and said curve adjustment value for said respective one of said R, G, and B self-emitting element groups and generating gray-scale voltages, said amplitude adjustment value and said curve adjustment value being set by said control register separately; and a decoder circuit for converting display data into gray-scale voltages among said gray-scale voltages generated by said gray-scale voltage generating circuits for said R, G, and B self-emitting element groups;

wherein said gray-scale voltages produced by said decoder circuit are output to said signal lines for said R, G, and B self-emitting element groups in said active matrix type self-emitting panel;

wherein said gray-scale voltage generating circuits for said R, G, and B self-emitting element groups each include:

an amplitude adjustment circuit for adjusting the amplitude voltage (the difference voltage) between gray-scale voltages for maximum and minimum gray-scale numbers based on said amplitude adjustment value for a respective one of said R, G, and B self-emitting element groups, said amplitude adjustment value being set by said control register separately;

a curve adjustment circuit for dividing said amplitude voltage obtained from said amplitude adjustment circuit into a plurality of voltages and adjusting them based on said curve adjustment value for said respective one of said R, G, and B self-emitting element groups to produce a plurality of reference gray-scale voltages for intermediate gray-scale numbers, said curve adjustment value being set by said control register separately; and an output circuit for subdividing said plurality of reference gray-scale voltages obtained from said curve adjustment circuit into desired gray-scale voltages; and wherein said output circuit assigns pray-scale numbers to said desired gray-scale voltages such that the number amount of gray-scale numbers between the gray-scale numbers for each two neighboring reference gray-scale voltages decreases with increasing gray-scale voltage.

2. A self-emitting display driving circuit for driving signal lines for an R self-emitting element group, a G self-emitting element group, and a B self-emitting element group, respectively, in an active matrix type self-emitting panel, said self-emitting display driving circuit comprising:

a control register for setting an amplitude adjustment value and a curve adjustment value for each of said R, G, and B self-emitting element groups, separately;

gray-scale voltage generating circuits each for adjusting an amplitude characteristic and a curve characteristic of a gray-scale number vs. gray-scale voltage characteristic curve of a respective one of said R, G, and B self-emitting element groups, separately, and generating gray-scale voltages; and a decoder circuit for converting display data into gray-scale voltages among said gray-scale voltages generated by said gray-scale voltage generating circuits for said R, G, and B self-emitting element groups;

wherein said gray-scale voltage generating circuits for said R, G, and B self-emitting element groups each include:

an amplitude adjustment circuit for adjusting the amplitude voltage (the difference voltage) between gray-scale voltages for maximum and minimum gray-scale numbers based on said amplitude adjustment value for a respective one of said R, G, and B self-emitting element groups, said amplitude adjustment value being set by said control register separately;

a curve adjustment circuit for dividing said amplitude voltage obtained from said amplitude adjustment circuit into a plurality of voltages and adjusting them based on said curve adjustment value for said respective one of said R, G, and B self-emitting element groups to produce a plurality of reference gray-scale voltages for intermediate gray-scale numbers, said curve adjustment value being set by said control register separately; and an output circuit for subdividing said plurality of reference gray-scale voltages obtained from said curve adjustment circuit into desired gray-scale voltages and assigning gray-scale numbers to said desired gray-scale voltages such that the number amount of gray-scale numbers between the gray-scale numbers for each two neighboring reference gray-scale voltages decreases with increasing gray-scale voltage; and wherein said gray-scale voltages produced by said decoder circuit are output to said signal lines for said R, G, and B self-emitting element groups in said active matrix type self-emitting panel.

3. A self-emitting display driving circuit for driving signal lines for an R self-emitting element group, a G self-emitting element group, and a B self-emitting element group, respectively, in an active matrix type self-emitting panel, said self-emitting display driving circuit comprising:

a control register for setting an amplitude adjustment value and a curve adjustment value for each of said R, G, and B self-emitting element groups, separately;

gray-scale voltage generating circuits each for adjusting an amplitude characteristic and a curve characteristic of a gray-scale number vs. gray-scale voltage characteristic curve of a respective one of said R, G, and B self-emitting element groups, separately, based on said amplitude adjustment value and said curve adjustment value for said respective one of said R, G, and B self-emitting element groups and generating gray-scale voltages, said amplitude adjustment value and said curve adjustment value being set by said control register separately; and a decoder circuit for converting display data into gray-scale voltages among said gray-scale voltages generated by said gray-scale voltage generating circuits for said R, G, and B self-emitting element groups;

wherein said gray-scale voltages produced by said decoder circuit are output to said signal lines for said R, G, and B self-emitting element groups in said active matrix type self-emitting panel;

wherein said gray-scale voltage generating circuits for said R, G, and B self-emitting element groups each include:

an amplitude adjustment circuit for adjusting the amplitude voltage (the difference voltage) between gray-scale voltages for maximum and minimum gray-scale numbers based on said amplitude adjustment value for a respective one of said R, G, and B self-emitting element groups, said amplitude adjustment value being set by said control register separately;

a curve adjustment circuit for dividing said amplitude voltage obtained from said amplitude adjustment circuit into a plurality of voltages and adjusting them based on said curve adjustment value for said respective one of said R, G, and B self-emitting element groups to produce a plurality of reference gray-scale voltages for intermediate gray-scale numbers, said curve adjustment value being set by said control register separately; and an output circuit for subdividing said plurality of reference gray-scale voltages obtained from said curve adjustment circuit into desired gray-scale voltages; and wherein said output circuit assigns gray-scale numbers to said desired gray-scale voltages such that the difference between each two neighboring gray-scale numbers to which reference gray-scale voltages are assigned decreases with decreasing gray-scale number.

4. A self-emitting display driving circuit for driving signal lines for an R self-emitting element group, a G self-emitting element group, and a B self-emitting element group, respectively, in an active matrix type self-emitting panel, said self-emitting display driving circuit comprising:

a control register for setting an amplitude adjustment value and a curve adjustment value for each of said R, G, and B self-emitting element groups, separately;

gray-scale voltage generating circuits each for adjusting an amplitude characteristic and a curve characteristic of a gray-scale number vs. gray-scale voltage characteristic curve of a respective one of said R, G, and B self-emitting element groups, separately, and generating gray-scale voltages; and a decoder circuit for converting display data into gray-scale voltages among said gray-scale voltages generated by said gray-scale voltage generating circuits for said R, G, and B self-emitting element groups;

wherein said gray-scale voltage generating circuits for said R, G, and B self-emitting element groups each include:

an amplitude adjustment circuit for adjusting the amplitude voltage (the difference voltage) between gray-scale voltages for maximum and minimum gray-scale numbers based on said amplitude adjustment value for a respective one of said R, G, and B self-emitting element groups, said amplitude adjustment value being set by said control register separately;

a curve adjustment circuit for dividing said amplitude voltage obtained from said amplitude adjustment circuit into a plurality of voltages and adjusting them based on said curve adjustment value for said respective one of said R, G, and B self-emitting element groups to produce a plurality of reference gray-scale voltages for intermediate gray-scale numbers, said curve adjustment value being set by said control register separately; and an output circuit for subdividing said plurality of reference gray-scale voltages obtained from said curve adjustment circuit into desired gray-scale voltages and assigning gray-scale numbers to said desired gray-scale voltages such that the difference between each two neighboring gray-scale numbers to which reference gray-scale voltages are assigned decreases with decreasing gray-scale number; and wherein said gray-scale voltages produced by said decoder circuit are output to said signal lines for said R, G, and B self-emitting element groups in said active matrix type self-emitting panel.

* * * * *